US007354006B1

(12) United States Patent
Bricker

(10) Patent No.: US 7,354,006 B1
(45) Date of Patent: Apr. 8, 2008

(54) CONFIGURABLE TRACK FOR TOY VEHICLES

(75) Inventor: Jeffrey D. Bricker, Chicago, IL (US)

(73) Assignee: RC2 Corporation, Oak Brook, IL (US)

( * ) Notice: Subject to any disclaimer, the term of this patent is extended or adjusted under 35 U.S.C. 154(b) by 310 days.

(21) Appl. No.: 11/129,567

(22) Filed: May 13, 2005

(51) Int. Cl.
*E01B 23/00* (2006.01)

(52) U.S. Cl. ..... 238/10 R; 238/10 E; 238/10 F

(58) Field of Classification Search ..... 238/10 R, 238/10 A, 10 B, 10 C, 10 E, 10 F
See application file for complete search history.

(56) References Cited

U.S. PATENT DOCUMENTS

| | | | | |
|---|---|---|---|---|
| 1,037,064 | A | 8/1912 | Shedd | |
| 1,914,116 | A | 6/1933 | Ford | |
| 2,185,691 | A | 1/1940 | Marion et al. | |
| 2,543,460 | A | 2/1951 | Larrabee | |
| 3,013,726 | A | 12/1961 | Orel | |
| D192,368 | S | 3/1962 | Genin et al. | |
| 4,544,094 | A | 10/1985 | Scholey | |
| 5,779,145 | A * | 7/1998 | Zelle et al. | 238/10 E |
| 5,813,351 | A | 9/1998 | Chen | |
| 5,979,783 | A | 11/1999 | Toht et al. | |
| 6,935,574 | B2 * | 8/2005 | Cheng | 238/10 B |

FOREIGN PATENT DOCUMENTS

| | | |
|---|---|---|
| WO | WO-93/03808 | 3/1993 |

* cited by examiner

*Primary Examiner*—Mark Le
(74) *Attorney, Agent, or Firm*—Reinhart Boerner Van Deuren s.c

(57) ABSTRACT

A configurable track segment for use in creating track layouts for toy vehicles is easily reconfigurable between three different configurations: having a male connector structure at one end thereof and a female connector structure at the other end thereof, having male connector structures at both ends thereof, and having female connector structures at both ends thereof. The configurable track segment includes a center piece and two end pieces. Each of the two end pieces has a male connector structure extending from one end thereof and a female connector structure formed at an opposite end thereof. The end pieces are attached to the center piece by link structures such that the end pieces may be rotated with respect to the center piece to present either the male or female connector structures thereof at the respective end of the track segment formed by the end piece.

20 Claims, 3 Drawing Sheets

CONFIGURABLE TRACK FOR TOY VEHICLES

FIELD OF THE INVENTION

This invention pertains generally to toy track systems for use with toy vehicles such as toy trains and automobiles and, more particularly, to systems and structures for joining together track segments that make up such toy track systems.

BACKGROUND OF THE INVENTION

Track assemblies employing interconnectable track sections or segments are widely employed for toy vehicles such as toy trains and toy automobiles and trucks, both motorized and unmotorized. Typically track sections or segments are provided in a kit and often can be connected together to form a variety of track layouts. Special track section pieces may be provided to create curves, banks, cross-overs, intersections and a variety of other desirable track lay out configurations.

Typically track sections or segments used to form a track layout are connected together via connectors formed at each end of the track segments.

For example, typical conventional track segments for toy vehicles include a male type connector structure (a projection) formed at one end of the track segment and a corresponding female type connector structure at the other end of the track segment. The track layout is formed by connecting the male connector structure of one track segment to the female connector structure of an adjacent segment in the layout. Special track segment pieces, e.g., intersections and the like, may have either male or female or both male and female connector structures formed thereon, to connect such pieces to other regular track segments.

A track for toy vehicles that is made from track segments where each piece has a male connector structure at one end and a female connector structure at the other end is limited in flexibility and ease of use. Especially when creating large and complicated track layouts, difficulties can arise unless the layout is well planned so that all of the pieces fit together properly to create a complete track circuit layout. Such difficulties can also be encountered by younger children when laying out even less complicated track systems.

What is desired, therefore, is a configurable track for toy vehicles in which the main track segment pieces are not limited to pieces having a male connector structure at one end and a female connector structure at the other end. In particular, what is desired is a track segment that is easily reconfigurable to have either a male connector structure at one end thereof and a female connector structure at the other end thereof, male connector structures at both ends thereof, or female connector structure at both ends thereof.

SUMMARY OF THE INVENTION

The present invention provides a configurable track segment for use in creating track layouts for toy vehicles. A configurable track segment in accordance with the present invention may be easily reconfigurable between three different configurations: a track segment having a male connector structure at one end thereof and a female connector structure at the other end thereof, a track segment having male connector structures at both ends thereof, and a track segment having female connector structures at both ends thereof. Such configurable track segments in accordance with the present invention make it more easy and fun to create track layouts, even large and complicated layouts, with reduced planning. In particular, such segments make it easier even for young children to create complicated track layouts.

A configurable track segment in accordance with the present invention includes a center piece and two end pieces. Each of the pieces has a track surface that may be shaped and/or decorated to create a track surface for the particular toy vehicles to be used on a track formed from the track segments. Each of the two end pieces has a male connector structure extending from one end thereof and a female connector structure formed at an opposite end thereof. The end pieces are attached to the center piece by link structures such that the end pieces may be rotated with respect to the center piece to present either the male or female connector structures thereof at the respective end of the track segment formed by the end piece. In this way, the track segment can be easily reconfigured to provide either a male and a female connector structure at the ends thereof, male connector structures at both ends thereof, or female connector structures at the ends thereof.

Track segments in accordance with the present invention may be formed of a variety of materials in any desired size and length. The pieces of a track segment in accordance with the present invention may be curved to provide curved track segments in accordance with the present invention.

Further objects, features, and advantages of the present invention will be apparent from the following detailed description thereof and accompanying drawings.

DETAILED DESCRIPTION OF THE INVENTION

Figure 1:
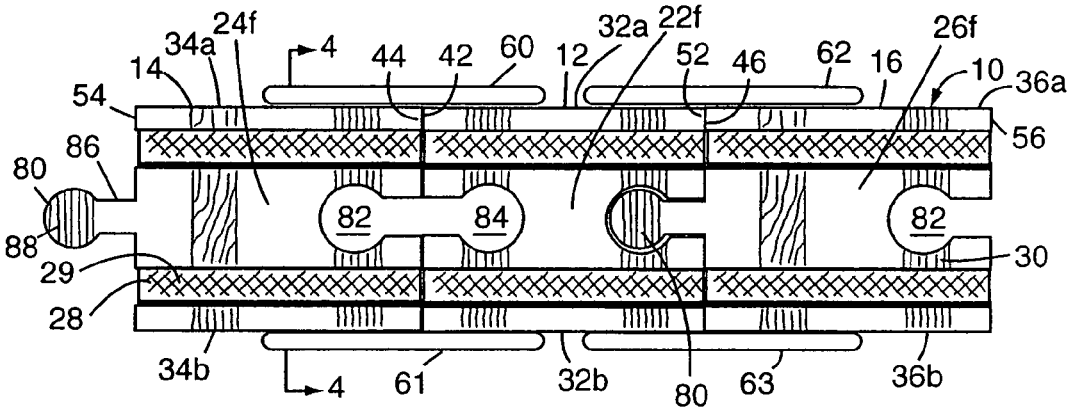
FIG. 1 is a plan view illustration of an exemplary configurable track segment in accordance with the present invention that is configured so as to have a male connector structure at one end thereof and a female connector structure at the other end thereof.

An exemplary track segment 10 in accordance with the present invention is illustrated in various views and configurations in, and will be described in detail with reference to, FIGS. 1-5. As will be described in more detail below, a track segment 10 in accordance with the present invention is easily reconfigurable between three useful configurations: a track segment having a male connector structure at one end thereof and a female connector structure at the other end thereof, a track segment having male connector structures at both ends thereof, and a track segment having female connector structures at both ends thereof.

A track segment in accordance with the present invention includes three track pieces or portions, a center piece portion 12, a first end piece portion 14, and a second end piece portion 16. Each such piece 12, 14, and 16 of the track segment 10 preferably may be made of a material such as wood that is cut or otherwise formed into the desired shape as described herein. Alternatively, each piece 12, 14, and 16 of the track 10 may be made of another appropriate material, such as plastic or metal, that is molded or otherwise formed into the desired shape. Any appropriate combination of materials may be used to form the pieces 12, 14, and 16 of the track segment 10 in the desired shape using any appropriate manufacturing technique therefore. Each of the track pieces 12, 14, and 16 forming a single track segment 10 in accordance with the present invention preferably may be made of the same materials, although different materials also may be used to form the track pieces 12, 14, and 16 of a single track segment 10.

Each of the pieces 12, 14, and 16 of a track segment 10 in accordance with the present invention has a front surface 22*f*, 24*f*, and 26*f* and a back surface 22*b*, 24*b* and 26*b*, respectively. Each of the pieces 12, 14, and 16 of a track segment 10 in accordance with the present invention has two opposed sides 32*a* and 32*b*, 34*a* and 34*b*, and 36*a* and 36*b*, respectively. Each of the pieces 12, 14 and 16 of a track segment 10 in accordance with the present invention also has two opposed first 42, 44, and 46 and second 52, 54, and 56 ends, respectively.

The front 22*f*, 24*f*, and 26*f* and back 22*b*, 24*b*, and 26*b* surfaces of the pieces 12, 14, and 16 of the track segment 10 preferably all are shaped and/or decorated in a desired manner to form a track surface running along the surfaces 22*f*, 24*f*, 26*f*, 22*b*, 24*b*, and 26*b* that is appropriate for the toy vehicles to be used with a track formed from the track segments 10 in accordance with the present invention. For example, the surfaces 22*f*, 24*f*, 26*f*, 22*b*, 24*b*, and 26*b* of the exemplary track segment 10 illustrated in the present application are shaped and decorated for use with a toy train. Parallel grooves 28 are formed longitudinally along the surfaces 22*f*, 24*f*, 26*f*, 22*b*, 24*b*, and 26*b* to form tracks in which the wheels of the toy train are run. These grooves 28 may be milled or otherwise cut in the surfaces 22*f*, 24*f*, 26*f*, 22*b*, 24*b*, and 26*b* of track segment pieces 12, 14 and 16 made of wood, or otherwise formed by molding or some other process depending upon the material from which the pieces 12, 14 and 16 are formed. Decorative or other markings 29 may be stamped or otherwise formed in the bottoms of the grooves 28. These stamped or other markings 29 may also provide traction for the train wheels running in the grooves 28. Other markings 30 may be cut, painted, and/or otherwise formed extending across the surfaces 22*f*, 24*f*, 26*f*, 22*b*, 24*b*, and 26*b*, e.g., at right angles to the grooves 28, to present the image of railroad ties. It should be understood that the surfaces 22*f*, 24*f*, 26*f*, 22*b*, 24*b*, and 26*b* of the pieces 12, 14, and 16 may be formed and decorated in many other ways, depending upon the type of toy vehicles to be used. For example, for different types of toy trains, raised rails may be formed extending longitudinally along the surfaces 22*f*, 24*f*, 26*f*, 22*b*, 24*b*, and 26*b*. The surfaces 22*f*, 24*f*, 26*f*, 22*b*, 24*b*, and 26*b* may be formed to be substantially flat or to have a single wide groove formed therein with appropriate painted or other markings to represent a road along which toy automobiles and trucks are run.

The pieces 12, 14, and 16 of a track segment 10 in accordance with the present invention are joined together such that the ends 42, 52, 44, 54, 46 and 56 thereof are adjacent and almost abutting by links 60, 61, 62, and 63. The center piece 12 and the first end piece 14 are joined together by a link 60 attached at one end thereof to the side 32*a* of the center piece 12 and at the other end thereof to the side 34*a* of the first end piece 14 at the center of the side 34*a* and by a link 61 attached at one end thereof to the side 32*b* of the center piece 12 and at the other end thereof to the side 34*b* of the first end piece 14 at the center of the side 34*b*. The center piece 12 and second end piece 16 are joined together by a link 62 attached at one end thereof to the side 32*a* of the center piece 12 and at the other end thereof to the side 36*a* of the second end piece 16 at the center of the side 36*b* and by a link 63 attached at one end thereof to the side 32*b* of the center piece 12 and at the other end thereof to the side 36*b* of the second end piece 16 at the middle of the side 36*b*. The links 60-63 preferably may be formed as elongated pieces of a material such as plastic, manufactured using conventional molding or stamping techniques. Alternatively, the links 60-63 may be made of any other appropriate material, such as metal or wood.

Figure 4:
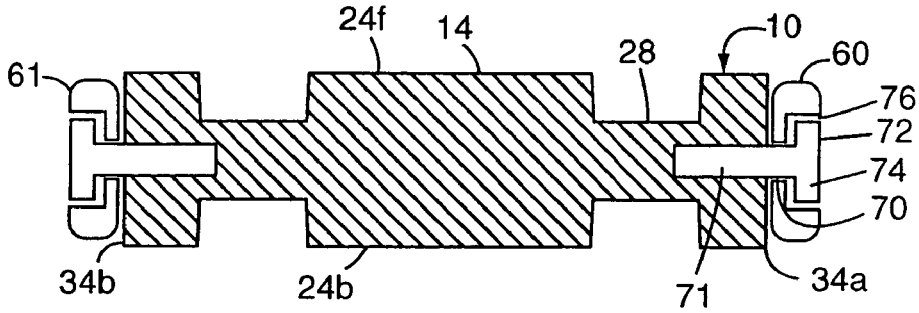
FIG. 4 is a cross section view illustration of the exemplary configurable track segment in accordance with the present invention of FIG. 1 as taken along the line 4-4 thereof.

The links 60-63 are attached to the sides 34*a*, 34*b*, 36*a* and 36*b* of the end pieces 14 and 16, and preferably also to the sides 32*a* and 32*b* of the center piece 12 such that the end pieces 14 and 16 are rotatable with respect to the links 60-63 and the middle piece 12. An exemplary attachment structure for this purpose is illustrated in FIG. 4. A mounting aperture 70 is formed, by stamping, molding, cutting, or any other appropriate method, through each link 60-63 at each position thereon where the link is to be attached to a side 32*a*, 32*b*, 34*a*, 34*b*, 36*a* and 36*b* of a piece 12, 14, and 16 of the track segment 10. The shaft 71 of a fastener 72, such as a nail, screw, rivet, or other similar structure, is extended through the mounting aperture 70 in the link 60-63 and embedded securely into the side 32*a*, 32*b*, 34*a*, 34*b*, 36*a* and 36*b* of the piece 12, 14 and 16 to which the link 60-63 is to be attached. The fastener 72 may be made of any appropriate material, such as, preferably, metal or a rigid and durable plastic material. Any appropriate method may be used for embedding the shaft 71 of the fastener 72 into the side 32*a*, 32*b*, 34*a*, 34*b*, 36*a* and 36*b* of a piece 12, 14 and 16 depending upon the type of fastener 72 employed and the material used to form the piece 12, 14, or 16 into which it is mounted, including the use of an appropriate adhesive. The diameter of the fastener shaft 71 is slightly smaller than the diameter of the mounting aperture 70 in the link 60-63, to allow free rotation of the shaft 71, and thus of the piece 12, 14, 16 in which the shaft is embedded, about the link 60-63. A head portion 74 of the fastener 72 is sized to be much larger than the mounting aperture 70 in the link 60-63, to prevent the link 60-63 from sliding off of the fastener 72 when the fastener 72 is mounted in a piece 12, 14, or 16 of the track segment 10. Preferably the links 60-63 are formed in a conventional manner with a recess 76 around the mounting aperture 70 such that the fastener head 74 may be recessed therein for safety and to provide a neat appearance.

Each of the end pieces 14 and 16 has a male connector structure 80 extending from one end 54 and 46 thereof, respectively, and a corresponding female connector structure 82 formed in the opposite end 44 and 56 thereof, respectively. The male 80 and female 82 connector structures are complementary such that adjacent track segments 10 in accordance with the present invention may be joined together by engaging a male 80 or female 82 connector structure at one end piece 14 of a one such segment 10 with the corresponding female 82 or male 80 connector structure at an other end piece 16 on another such segment 10. Recesses 84 are formed in both ends 42 and 52 of the middle piece 12 of the segment 10 such that when either of the end pieces 14 or 16 is rotated with respect to the middle piece such that the ends 54 and 46 thereof with the male connector structures 80 extending therefrom are adjacent to the middle piece, the connector structures 80 are received in the recesses. The recesses 84 preferably may, but need not necessarily, have the same size and shape as the female connector structures 82 formed in the end pieces 14 and 16.

Figure 2:
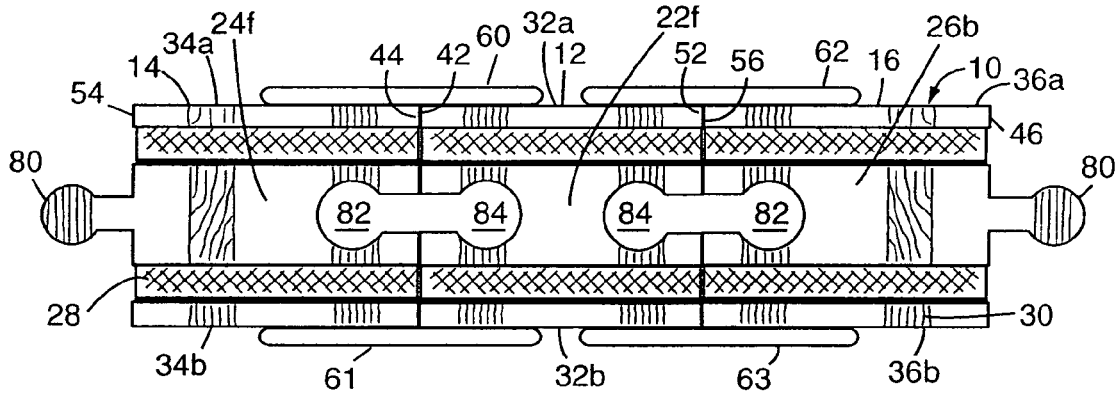
FIG. 2 is a plan view illustration of the exemplary configurable track segment in accordance with the present invention of FIG. 1 that is configured so as to have male connector structures at both ends thereof.
Figure 3:
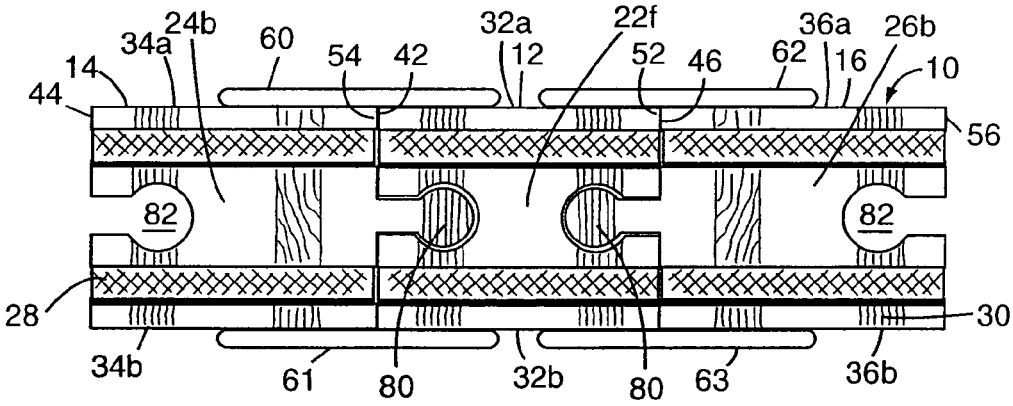
FIG. 3 is a plan illustration of the exemplary configurable track segment in accordance with the present invention of FIG. 1 that is configured so as to have female connector structures at both ends thereof.
Figure 5:
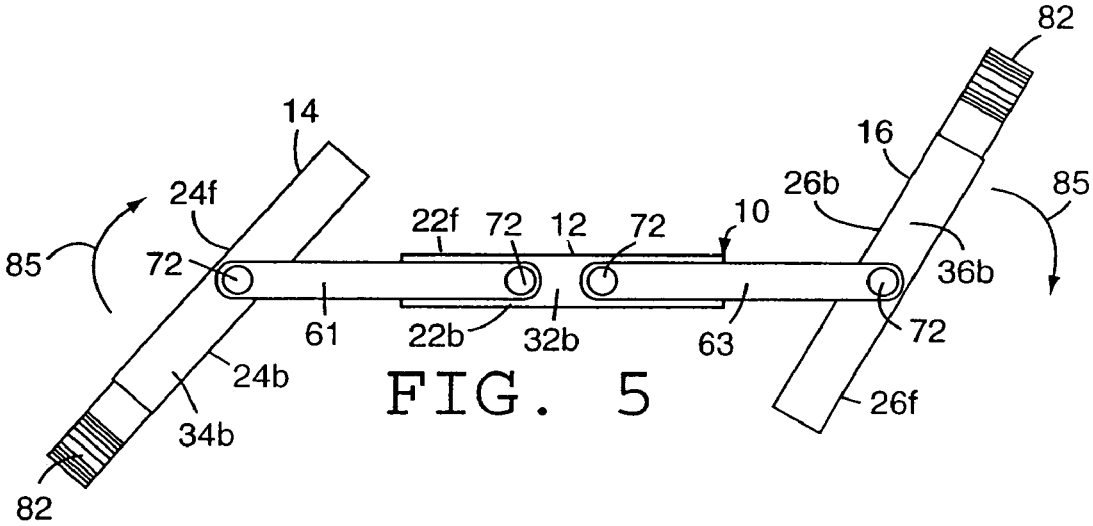
FIG. 5 is a side view illustration of the exemplary configurable track segment in accordance with the present invention of FIG. 1 showing rotation of the end piece portions thereof with respect to a center piece portion thereof.

As illustrated in FIGS. 1-3, a track segment 10 in accordance with the present invention may easily be adapted or configured to have either a male connector structure 80 at one end thereof and a female connector structure 82 at the other end thereof (FIG. 1), male connector structures 80 at both ends thereof (FIG. 2), or female connector structures 82 at both ends thereof (FIG. 3). The desired configuration for each track segment 10 used to form a track for toy vehicles is easily accomplished simply by rotating 85 the ends 14 and 16 of the track segment 10 about the links 60-63 (e.g., as illustrated in FIG. 5) such that the desired connector structure, male 80 or female 82, appears at each end of the track segment 10. Thus, configurable track segments 10 in accordance with the present invention may be used easily, even by small children, to create a wide variety of track lay outs.

Conventional male connector structures 80 (and corresponding female connector structures 82) are illustrated in the figures of the present application. These connector structures 80 include a straight section 86 with a wider circular portion 88 at the distal end of the straight section 86. It should be understood, however, that the male 80 and complementary female 82 connector structures may be of any appropriate size and shape, and are not limited to those illustrated and described herein.

Figure 6:
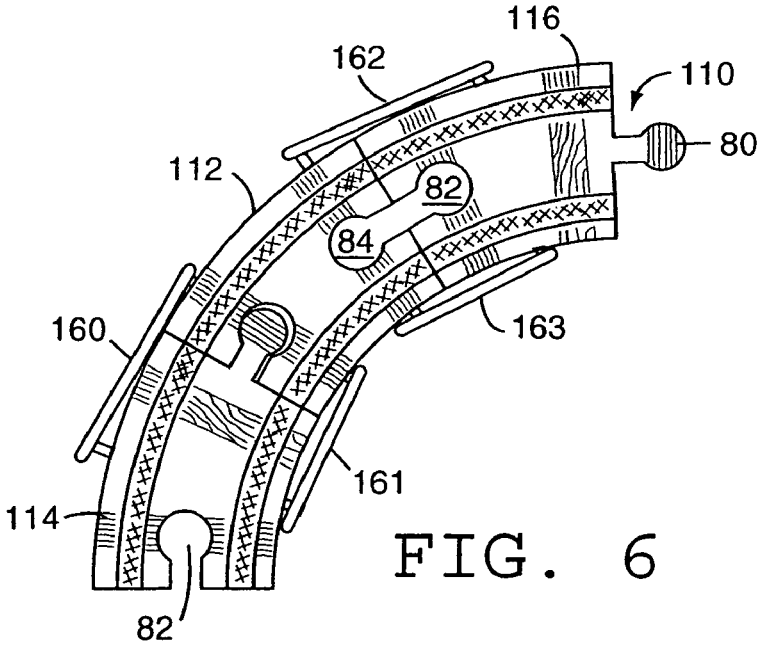
FIG. 6 is a plan view illustration of an alternative embodiment curved exemplary configurable track segment in accordance with the present invention.

The pieces 12, 14, and 16 of a track segment 10 in accordance with the present invention may be of any appropriate desired size, width, and/or length. Additionally, as illustrated in FIG. 6, the center 112 and/or end pieces 114 and 116 of an alternative embodiment track segment 110 in accordance with the present invention may be curved to form a curved track segment 110 in accordance with the present invention. In such an embodiment 110 the links 160-163 joining the pieces 112, 114 and 116 together are designed and attached appropriately to the pieces 112, 114 and 116, e.g., in the manner described above, to allow rotation of the end pieces 114 and 116 such that the curved track segment may have either a male connector structure 80 at one end and a female connector structure 82 at the other end (as illustrated in FIG. 6), male connector structures 80 at both ends, or female connector structures 82 at both ends.

Figure 7:
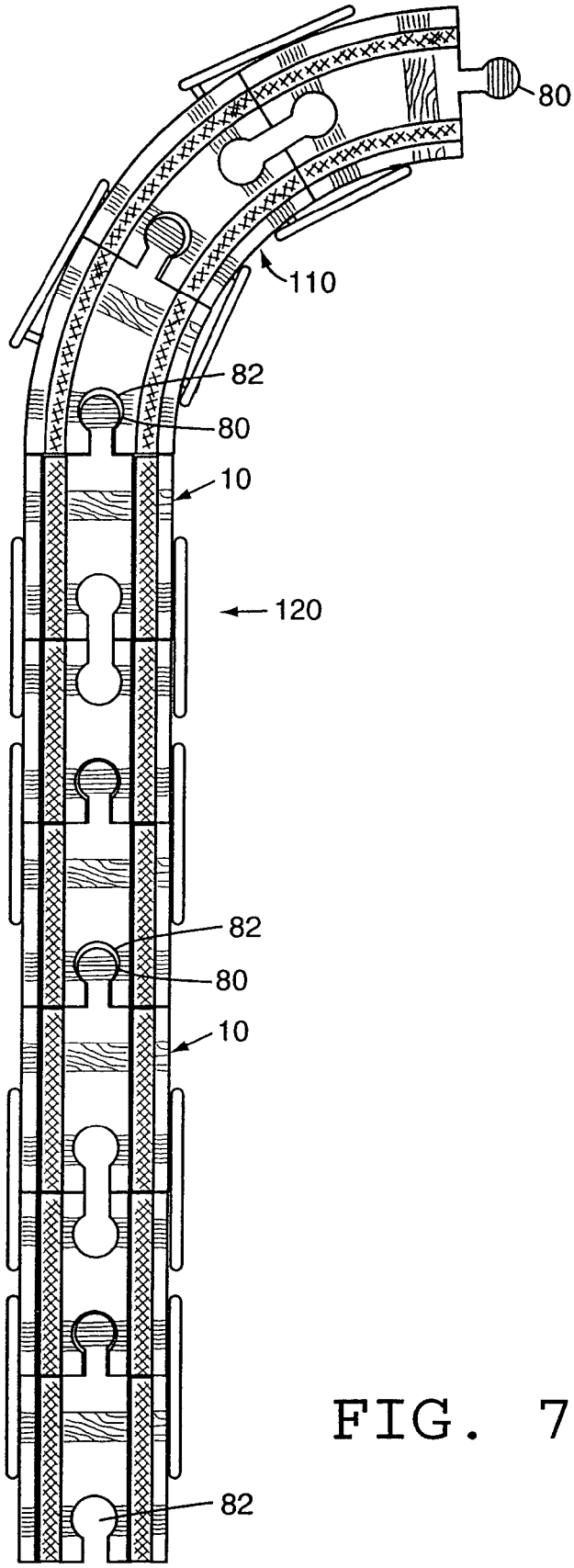
FIG. 7 is a plan view illustration of a plurality of configurable track segments in accordance with the present invention as illustrated in FIGS. 1 and 6 as joined together to form a larger track section.

A portion of a track lay out formed using a plurality of straight 10 and curved 110 track segments in accordance with the present invention is illustrated in FIG. 7.

It should be understood that the present invention is not limited to the particular exemplary embodiments and applications illustrated and described herein, but embraces all such modified forms thereof as come within the scope of the following claims.

What is claimed is:

1. A track segment for toy vehicles, said track segment comprising:

(a) a center track piece having front and back track surfaces, first and second sides, and first and second ends;

(b) a first end track piece having front and back surfaces, first and second sides, first and second ends, a male connector structure extending from the first end thereof and a corresponding female connector structure formed in the second end thereof, and a first attachment structure attaching the first end track piece to the center track piece adjacent to the first end thereof such that the first end track piece is rotatable on a pivot on the attachment structure and with respect to the center track piece so as to move the male connector structure or the female connector structure of the first end track piece to a first end of the track segment; and (c) a second end track piece having front and back surfaces, first and second sides, first and second ends, a male connector structure extending from the first end thereof and a corresponding female connector structure formed in the second end thereof, and a second attachment structure attaching the second end track piece to the center track piece adjacent to the second end thereof such that the second end piece is rotatable with respect to the center track piece such that either the male connector structure or the female connector structure of the second end track piece is presented at a second end of the track segment.

2. The track segment of claim 1 wherein the center track piece, the first end track piece, and the second end track piece are made of wood.

3. The track segment of claim 1 wherein the front and back surfaces of the center track piece, the front and back surfaces of the first end track piece, and the front and back surfaces of the second end track piece are formed to form a track surface adapted for a toy train vehicle.

4. The track segment of claim 1 comprising additionally apertures formed in the first and second ends of the center piece that are adapted to receive the male connector structures extending from the first and second end track pieces respectively when the first and second end track pieces are rotated with respect to the center track piece such that the first ends thereof are adjacent to the first and second ends respectively of the center piece.

5. The track segment of claim 1 wherein at least one of the center track piece, the first end track piece, or the third end track piece is curved.

6. The track segment of claim 1 wherein the male connector structures extending from the first end track piece and from the second end track piece include a straight extending portion with a larger circular portion formed at the distal end of the straight extending portion.

7. A track segment for toy vehicles, said track segment comprising:

(a) a center track piece having front and back track surfaces, first and second sides, and first and second ends;

(b) a first end track piece having front and back surfaces, first and second sides, first and second ends, a male connector structure extending from the first end thereof and a corresponding female connector structure formed in the second end thereof, and wherein the first end track piece is attached to the center track piece adjacent to the first end thereof such that the first end track piece is rotatable with respect to the center track piece such that either the male connector structure or the female connector structure of the first end track piece is presented at a first end of the track segment; and (c) a second end track piece having front and back surfaces, first and second sides, first and second ends, a male connector structure extending from the first end thereof and a corresponding female connector structure formed in the second end thereof, and wherein the second end track piece is attached to the center track piece adjacent to the second end thereof such that the second end piece is rotatable with respect to the center track piece such that either the male connector structure or the female connector structure of the second end track piece is presented at a second end of the track segment, wherein, the first end track piece is attached to the center track piece by a first link piece rotatably attached at a first end thereof to the first side of the first end track piece and attached at a second end thereof to the first side of the center track piece, and by a second link piece rotatably attached at a first end thereof to the second side of the first end track piece and attached at a second end thereof to the second side of the center track piece; and wherein, the second end track piece is attached to the center track piece by a third link piece rotatably attached at a first end thereof to the first side of the second end track piece and attached at a second end thereof to the first side of the center track piece and by a fourth link piece rotatably attached at a first end thereof to the second side of the second end track piece and attached at a second end thereof to the second side of the center track piece.

8. The track segment of claim 7 wherein the first, second, third, and fourth link pieces are made of plastic.

9. A track system kit for toy vehicles, said track system kit comprising:

a plurality of interconnectable track segments, wherein each of the plurality of interconnectable track segments in the kit comprises:

(a) a center track piece having front and back track surfaces, first and second sides, and first and second ends;

(b) a first end track piece having front and back surfaces, first and second sides, first and second ends, a male connector structure extending from the first end thereof and a corresponding female connector structure formed in the second end thereof, and a first attachment structure attaching the first end track piece to the center track piece adjacent to the first end thereof such that the first end track piece is rotatable on a pivot on the attachment structure and with respect to the center track piece so as to move the male connector structure or the female connector structure of the first end track piece to a first end of the track segment; and (c) a second end track piece having front and back surfaces, first and second sides, first and second ends, a male connector structure extending from the first end thereof and a corresponding female connector structure formed in the second end thereof, and a second attachment structure attaching the second end track piece to the center track piece adjacent to the second end thereof such that the second end piece is rotatable with respect to the center track piece such that either the male connector structure or the female connector structure of the second end track piece is presented at a second end of the track segment.

10. The track system kit of claim 9 wherein the center track piece, the first end track piece, and the second end track piece of each of the track segments are made of wood.

11. The track system kit of claim 9 wherein the front and back surfaces of the center track piece, the front and back surfaces of the first end track piece, and the front and back surfaces of the second end track piece of each of the track segments are formed to form a track surface adapted for a toy train vehicle.

12. The track system kit of claim 9 comprising additionally for each track segment apertures formed in the first and second ends of the center piece that are adapted to receive the male connector structures extending from the first and second end track pieces respectively when the first and second end track pieces are rotated with respect to the center track piece such that the first ends thereof are adjacent to the first and second ends respectively of the center piece.

13. The track system kit of claim 9 wherein at least one of the track segments is curved.

14. The track system kit of claim 9 wherein for each of the track segments the male connector structures extending from the first end track piece and from the second end track piece include a straight extending portion with a larger circular portion formed at the distal end of the straight extending portion.

15. A track system kit for toy vehicles, said track system kit comprising:

a plurality of interconnectable track segments, wherein each of the plurality of interconnectable track segments in the kit comprises:

(a) a center track piece having front and back track surfaces, first and second sides, and first and second ends;

(b) a first end track piece having front and back surfaces, first and second sides, first and second ends, a male connector structure extending from the first end thereof and a corresponding female connector structure formed in the second end thereof, and wherein the first end track piece is attached to the center track piece adjacent to the first end thereof such that the first end track piece is rotatable with respect to the center track piece such that either the male connector structure or the female connector structure of the first end track piece is presented at a first end of the track segment; and (c) a second end track piece having front and back surfaces, first and second sides, first and second ends, a male connector structure extending from the first end thereof and a corresponding female connector structure formed in the second end thereof, and wherein the second end track piece is attached to the center track piece adjacent to the second end thereof such that the second end piece is rotatable with respect to the center track piece such that either the male connector structure or the female connector structure of the second end track piece is presented at a second end of the track segment, wherein, for each track segment, the first end track piece is attached to the center track piece by a first link piece rotatably attached at a first end thereof to the first side of the first end track piece and attached at a second end thereof to the first side of the center track piece, and by a second link piece rotatably attached at a first end thereof to the second side of the first end track piece and attached at a second end thereof to the second side of the center track piece; and wherein, the second end track piece is attached to the center track piece by a third link piece rotatably attached at a first end thereof to the first side of the second end track piece and attached at a second end thereof to the first side of the center track piece and by a fourth link piece rotatably attached at a first end thereof to the second side of the second end track piece and attached at a second end thereof to the second side of the center track piece.

16. The track system kit of claim 15 wherein the first, second, third, and fourth link pieces are made of plastic.

17. A track segment for toy vehicles, said track segment comprising:

(a) a center track piece having front and back track surfaces, first and second sides, and first and second ends;

(b) a first end track piece having front and back surfaces, first and second sides, first and second ends, a male connector structure extending from the first end thereof and a corresponding female connector structure formed in the second end thereof, and wherein the first end track piece is attached to the center track piece adjacent to the first end thereof such that the first end track piece is rotatable with respect to the center track piece such that either the male connector structure or the female connector structure of the first end track piece is presented at a first end of the track segment, wherein the first end track piece is attached to the center track piece by a first link piece rotatably attached at a first end thereof to the first side of the first end track piece and attached at a second end thereof to the first side of the center track piece, and by a second link piece rotatably attached at a first end thereof to the second side of the first end track piece and attached at a second end thereof to the second side of the center track piece.

18. A track segment for toy vehicles, said track segment comprising:

(a) a center track piece having front and back track surfaces, first and second sides, and first and second ends;

(b) a first end track piece having front and back surfaces, first and second sides, first and second ends, a male connector structure extending from the first end thereof and a corresponding female connector structure formed in the second end thereof, and an attachment structure attaching the first end track piece to the center track piece adjacent to the first end thereof such that the first end track piece is rotatable on a pivot on the attachment structure and with respect to the center track piece so as to move the male connector structure or the female connector structure of the first end track piece to a first end of the track segment.

19. The track segment of claim 18 comprising additionally an aperture formed in the first end of the center piece that is adapted to receive the male connector structure extending from the first end track piece when the first end track pieces is rotated with respect to the center track piece such that the first end thereof is adjacent to the first end of the center piece.

20. The track segment of claim 18 wherein the male connector structure extending from the first end track piece includes a straight extending portion with a larger circular portion formed at the distal end of the straight extending portion.

* * * * *